US006256842B1

(12) United States Patent
Ina

(10) Patent No.: US 6,256,842 B1
(45) Date of Patent: Jul. 10, 2001

(54) HOOKING DEVICE

(75) Inventor: Toshiyuki Ina, Fukuyama (JP)

(73) Assignee: Morito Co., Ltd., Osaka (JP)

( * ) Notice: Subject to any disclaimer, the term of this patent is extended or adjusted under 35 U.S.C. 154(b) by 0 days.

(21) Appl. No.: 09/473,602

(22) Filed: Dec. 29, 1999

(30) Foreign Application Priority Data

Sep. 17, 1999 (JP) ..... 11-263794

(51) Int. Cl.[7] ..... A44B 11/25

(52) U.S. Cl. ..... 24/194; 24/171; 24/181; 24/195; 24/585

(58) Field of Search ..... 24/194, 195, 171, 24/181, 573.1, 615, 582, 583, 585

(56) References Cited

U.S. PATENT DOCUMENTS 3,208,124 * 9/1965 Rossi ..... 24/181
3,402,439 * 9/1968 Currat ..... 24/194
4,780,939 * 11/1988 Belter ..... 24/585
4,945,614 * 8/1990 Kasai ..... 24/194

* cited by examiner

*Primary Examiner*—Victor N. Sakran
(74) *Attorney, Agent, or Firm*—Merchant & Gould P.C.

(57) ABSTRACT

A hooking device comprises a male hook (1) attached to one side of the opening of a garment (F) and a female hook (4) attached to the other side of the opening in such a way that it can be hooked to and unhooked from said male hook (1). The male hook (1) comprises a male hook base (11), a male hook main body (21) and a spring (31). On the male hook base (11), a groove (12) housing the spring (31) is longitudinally formed. The male hook main body (21) secures a space for housing the spring (31) between itself and the male hook base (11) and is provided with a hooking piece (22) for hooking to said female hook (4). The spring (31) is housed in said male hook base (11) in such a way that it elastically controls the sliding movement of the male hook main body (21) with respect to the male hook base (11).

7 Claims, 7 Drawing Sheets

HOOKING DEVICE

FIELD OF THE INVENTION

The present invention relates to a hooking device used with trousers and skirts, etc., for the purpose of automatically adjusting the waist size within a certain range.

BACKGROUND OF THE INVENTION

Conventionally, in order to facilitate the putting on or taking off of garments such as trousers and skirts (hereinafter "garments"), the opening of the waist thereof is provided with a pair of hooks comprising a male hook having a hooked end and a female hook that is shaped in such a way as to hang on said male hook. In order to allow adjustment in accordance with the waist size of the wearer, a hooking means has been used in which several female hooks are arranged on one side of the opening, and a male hook that is attached to the other side of the opening hooks onto the most appropriate of the several female hooks. The opening of the garment can be closed or opened by hooking or unhooking the male and female hooks, and the waist size can be adjusted within a certain range by choosing the appropriate female hook.

There are also garments that employ an elastic material such as a rubber belt in some parts of the waist, in which said rubber belt shrinks or expands to facilitate the putting on or taking off of the garment and to adjust to the waist size.

The above means employing several female hooks and a male hook that hooks onto the most appropriate of them is accompanied by a problem, that is, it is difficult to sew and arrange the female hooks at pitches smaller than a certain pitch. If many female hooks are arranged close to one another, the wearer needs to be very careful when attempting to hook the male hook to the appropriate female hook. Otherwise the wearer can end up hooking the male hook to the wrong female hook, resulting in the wrong waist size. For this reason, the female hooks cannot be arranged at pitches smaller than a certain pitch, and as such, the waist size of the garments cannot be finely adjusted.

After a meal or when the wearer applies a strain on the abdomen, the abdominal pressure strengthens and pushes out the garment around the waist line, causing a pain in the abdomen. Conventionally, this problem has been dealt with by loosening the hooks or unhooking them. This kind of operation is not only troublesome but can also make the wearer look untidy and cause unpleasant feelings among other people.

Garments employing an elastic material such as a rubber belt in some parts of the waist, in which said rubber belt shrinks or expands to facilitate putting on or taking off the garments and to adjust the waist size, tend to generate many wrinkles in the fabric around the elastic material, thereby spoiling the appearance of the garments. As such, this kind of garment can be used only for a limited range of applications and not for suits or formal wear.

When many female hooks are sewn onto a garment, these female hooks are individually sewn along the waist line at a certain pitch. When an elastic material is used in some parts of a garment, the elastic material needs to be sewn over a wide range of its length. Either way, the sewing efficiency is low, and this pushes up the sewing cost.

SUMMARY OF THE INVENTION

The object of the present invention, therefore, is to provide a hooking device that is equipped with a means for automatically adjusting the positions of the opposing sides of the opening of the garment in accordance with the wearer's abdominal pressure, that does not generate wrinkles in the fabric when the hooking device is sewn onto the garment or when the garment is worn, and that reduces the sewing cost by reducing the number of steps required to sew the hooking device onto the garment.

The present invention has been conceived in order to solve the above problems, and is in its basic form a hooking device comprising a male hook attached to one side of the opening of a garment and a female hook attached to the other side of the opening in such a way that it can be hooked to and unhooked from said male hook; said male hook comprising: a male hook base on which a groove housing a later-described elastic body is longitudinally formed; a male hook main body which secures a space for housing the later-described elastic body between itself and the male hook base and is provided with a means for hooking to said female hook, wherein said male hook base also functions as a guide member; and the elastic body housed in said male hook base in such a way that it elastically controls the sliding movement of the male hook main body with respect to the male hook base by means of compression or tension.

In another embodiment of the present invention, sliding rails are provided on both ends of the male hook base, both ends of the male hook main body are folded back to one surface so as to form holding arms that hold the sliding rails in such a way that rails can slide freely within them, the male hook base and the male hook main body are attached to each other in such a way that they can slide by each other with the holding arms holding the sliding rails, and a stopper means is provided for preventing these parts from becoming separated from each other.

In another embodiment of the present invention, the male hook base and the male hook main body are equipped with, respectively, a stopper protrusion and a pusher protrusion, both of which protrude into the housing space, wherein both ends of the elastic body housed in the groove are compressed by said stopper protrusion and pusher protrusion in order to elastically control the sliding movement of the male hook main body with respect to the male hook base.

In still another embodiment, the elastic body is formed by bending a metal band material in the form of bellows having a width that allows it to be housed in the groove.

In still another embodiment, the male hook and the female hook are curved along the waist line. In this embodiment, one end of the elastic body makes contact with protruding pieces formed on the back surface of the end that is opposite the end of the mail hook main body where the hooking piece is formed, and the other end of which is caught and fastened by the bend of a stopping piece erected from the male hook base, and the hooking space of the hooking piece continues to the gap between the tip of the hooking piece and the male hook main body while being narrowed along the way by an inclined step provided between the fold and the tip of the hooking piece.

According to the hooking device of the present invention, the male hook comprises a male hook base on which a groove housing a later-described elastic body is longitudinally formed, a male hook main body which secures a space for housing the later-described elastic body between itself and the male hook base and is provided with a means for hooking onto said female hook, wherein said male hook base also functions as a guide member, and the elastic body housed in said male hook base in such a way that it elastically controls the sliding movement of the male hook main body with respect to the male hook base by means of compression or tension. Because of such configuration, the present invention features a size-adjusting function that acts in accordance with the abdominal pressure, wherein an elastic power always acts in the direction that tightens the opening of the garment and the waist size is automatically and steplessly adjusted so that it is just right for the wearer.

After a meal or when the wearer applies a strain on the abdomen, the elastic body shrinks or expands in accordance with the changes of the waist size, and accordingly the garment fits the waist size, causing no unpleasantness around the abdominal area. Therefore, it is not necessary to loosen or unhook the hooks, and the wearer need have no concern about looking untidy or causing unpleasant feelings among other people.

Because the hooking device itself is stretchable, and the garment is not provided with a stretchable design, no wrinkles are generated in the fabric of the garment and the appearance of the garment is not spoilt either. The application of the hooking device of the present invention is, therefore, not restricted to garments that are prone to wrinkling; it can also be used for suits or formal wear for which appearance is very important.

When sewing the hooking device onto the garment, it is unnecessary to attach many female hooks or to sew in a rubber belt over a wide range of its length. The stretchability can be added by simply attaching the male hook and the female hook, and this results in high sewing efficiency and reduced sewing cost.

Because the elastic body housed inside the male hook is bent in the form of bellows having a width that allows it to be housed within the groove, the male hook can be made very thin while maintaining sufficient stretchability. The elastic body is also easy to manufacture, making it possible to produce a hooking device that is pleasant to use and does not spoil the appearance of the garment.

The above features of the present invention make it possible to provide a hooking device that is equipped with a means for automatically adjusting the positions of the ends of the opening of the garment in accordance with the wearer's abdominal pressure, that does not generate wrinkles in the fabric when the hooking device is sewn onto the garment or when the garment is worn, and that reduces the sewing cost by reducing the number of steps required to sew the hooking device onto the garment.

BRIEF DESCRIPTION OF THE DRAWINGS

Some of the objects and advantages of the present invention having been stated, others will appear as the description proceeds when considered in conjunction with the accompanying drawings in which.

DETAILED DESCRIPTION OF THE PREFERRED EMBODIMENTS

EXAMPLE 1

Figure 1:
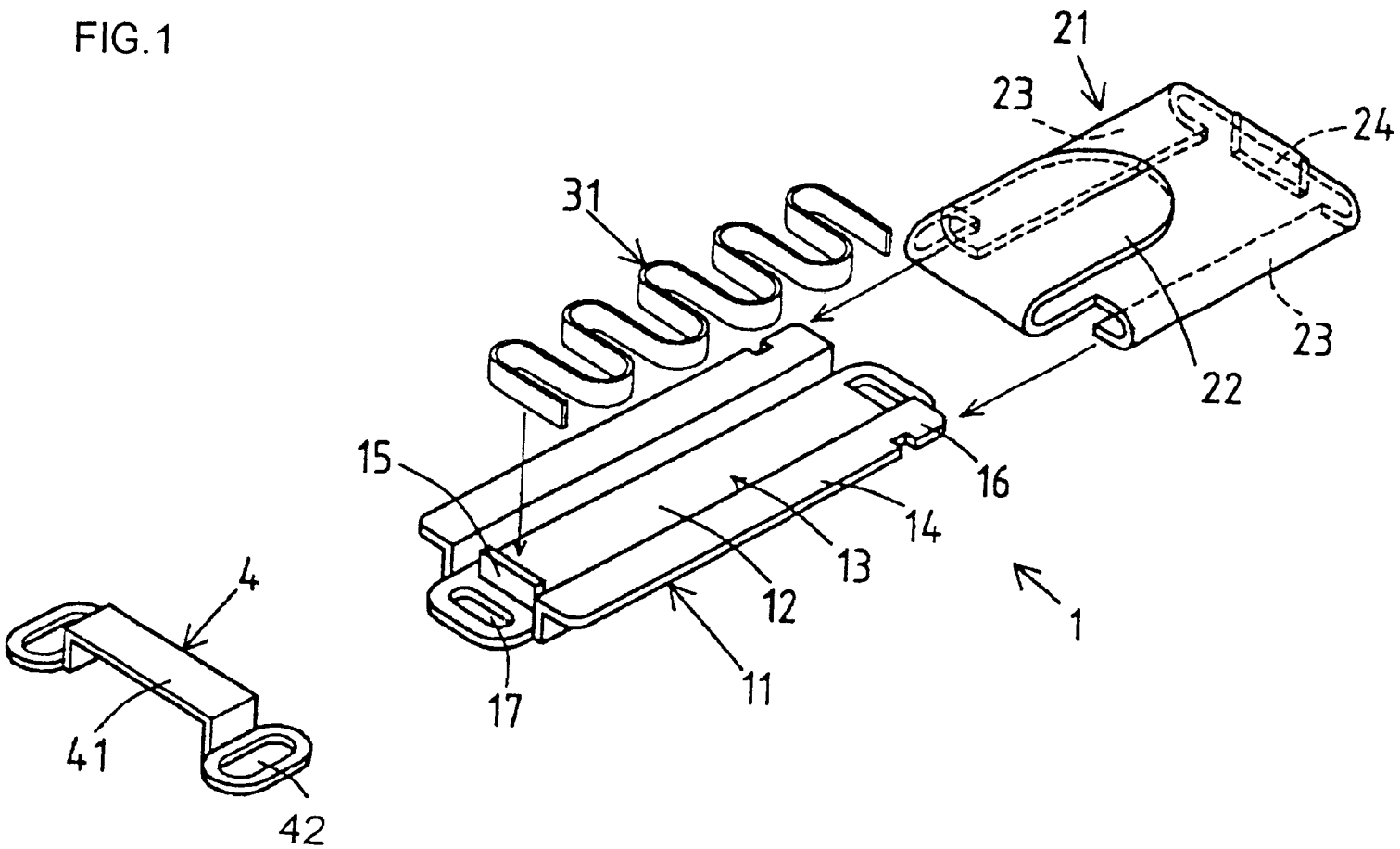
FIG. 1 is a perspective view of the hooking device according to Example 1.

A hooking device according to Example 1 of the present invention will now be described with reference to the accompanying FIGS. 1–4.

It is apparent from these drawings that the hooking device of the present invention comprises the male hook (1) attached to one side of the opening of the garment (F) and a female hook (4) attached to the other side of the opening in such a way that it can be hooked onto and unhooked from said male hook (1). The male hook (1) is further comprised of a male hook base (11) that is attached to one side of the opening of the garment (F) by means of sewing, a male hook main body (21) that engages with said male hook base (11) in a sliding manner and secures a space for housing a later-described elastic body (31) between itself and the male hook base (11), and the elastic body (31) that is housed in the housing space and controls the sliding movement of the male hook main body (21) with respect to the male hook base (11) by means of compression.

As shown in FIG. 1, the male hook base (11) is made by stamping, pressing and bending a stainless steel sheet of a thickness of 0.6 mm into a form measuring 11.5 mm in width by 31 mm in length by 2.4 mm in thickness and provided on its longitudinal center with a concave groove (12) having a uniform cross section and a width of 6.0 mm and a depth of 1.8 mm. On either side of the groove (12) there is a sliding rail (14) that functions as a guide along which the male hook main body (21) slides, and at either end of the groove bottom (13) there is a tongue on which a sewing hole (17) is opened. At one end of the groove bottom (13) there is a slit from which a bent stopper protrusion (15) protrudes into the groove (12). Near the other end of the male hook base (11), a slit is provided on each sliding rail (14) at positions equidistant from the end of the male hook base (11). These slits form slip-off-preventive pieces (16).

The male hook main body (21) is also made by stamping, pressing and bending a stainless steel sheet of a thickness of 0.6 mm in the same way as the male hook base (11). So as to hold the sliding rails (14) of the male hook base (11) in a sliding manner, both sides are folded on one surface to form holding arms (23) while securing a width of 12.6 mm and a gap of 1.2 mm. A tongue formed at one end is folded on the side opposite the surface on which the holding arms (23) are folded to form a hooked end (22) that hooks onto the female hook (4), and another tongue formed at the other end is folded on the same surface as the folding arms (23) and protrudes inside the housing space, forming a pusher protrusion (24) that pushes the elastic body (31).

Said elastic body (31) is a leaf spring made by bending a metal band of a height of 1.2 mm and a thickness of 0.3 mm in the form of bellows so that it can be housed within the groove (12) formed inside the male hook (1), and of a width of 5.0 mm.

Said female hook (4) is formed by bending a stainless steel sheet, and equipped with a catch (41) wide enough to hook onto the hooked end (22) of the hook main body (21) and a sewing hole (42) on either side of said catch (41) so that the catch can be sewn onto the opening of the garment (F).

Figure 2:
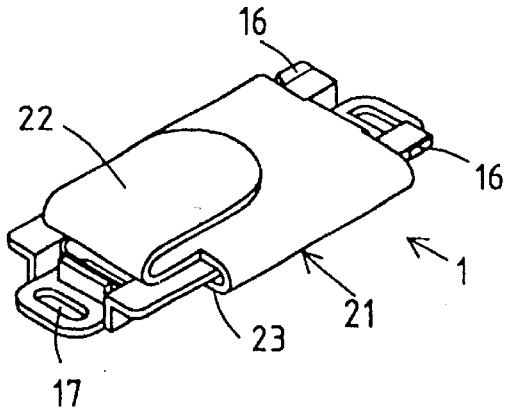
FIG. 2 is a perspective view of the male hook.
Figure 3:
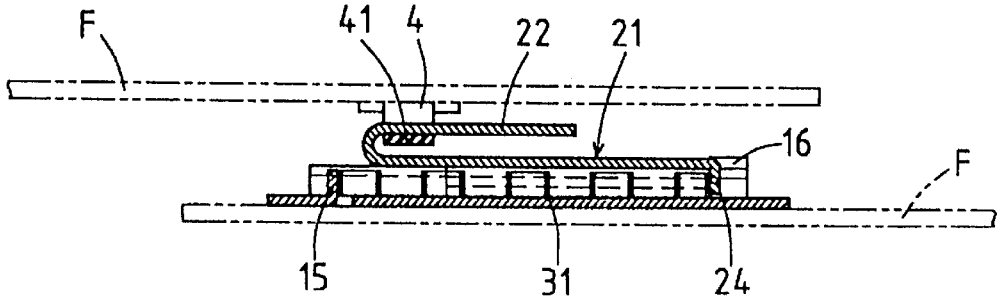
FIG. 3 is a longitudinal section view of the hooking device as it is attached to the opening of a garment.

The assembly of the hooking device of the present invention is as follows. As shown in FIGS. 1 through 3, the elastic body (31) is housed in the groove (12) of the male hook base (11) in such a way as to make contact with the stopper means (15). The male hook main body (21) is slid in from the side where the hooked end (22) is formed so as to hold the sliding rails (14) with the holding arms (23). As the pusher protrusion (24) formed on the male hook main body (21) compresses the elastic body (31), the slip-off-preventive pieces (16) formed on the sliding rails (14) are bent upwards in such a way that the male hook (1) does not slip off from the sliding rails (14).

Figure 4:
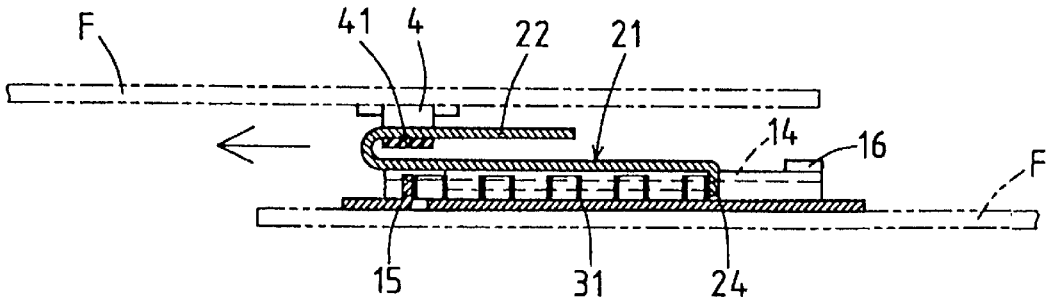
FIG. 4 is a longitudinal section view of the hooking device of FIG. 3 in which the male hook main body is sliding.

Next, as shown in FIG. 4, when the female hook (4) attached to the opening of the waist of the garment (F) and the male hook main body (21) attached to said female hook (4) are pulled in resistance to the elasticity of the elastic body (31), the elastic body (31) is compressed by the stopper protrusion (15) and the pusher protrusion (24), and the male hook main body (21) moves relative to the male hook base (11), thereby expanding the waist size of the garment (F). On the other hand, when the force that pulls the male hook main body (21) decreases, the elastic force of the elastic body (31) pulls the male hook main body (21) in the direction that reduces the waist size of the garment (F). Accordingly, the waist of the garment (F) is always adjusted to the wearer's optimal size automatically.

EXAMPLE 2

A hooking device according to Example 2 of the present invention will now be described with reference to FIGS. 5–7.

It is apparent from these drawings that the hooking device of the present invention comprises the male hook (1) attached to one side of the opening of the garment (F) and a female hook (4) attached to the other side of the opening in such a way that it can be hooked onto and unhooked from said male hook (1). The male hook (1) is further comprised of a male hook base (11) that is attached to one side of the opening of the garment (F) by means of claws, a male hook main body (21) that engages with said male hook base (11) in a sliding manner and secures a space for housing a later-described elastic body (31) between itself and the male hook base (11), and the elastic body (31) that is housed in the housing space and controls the sliding movement of the male hook main body (21) with respect to the male hook base (11) by means of compression.

Figure 5:
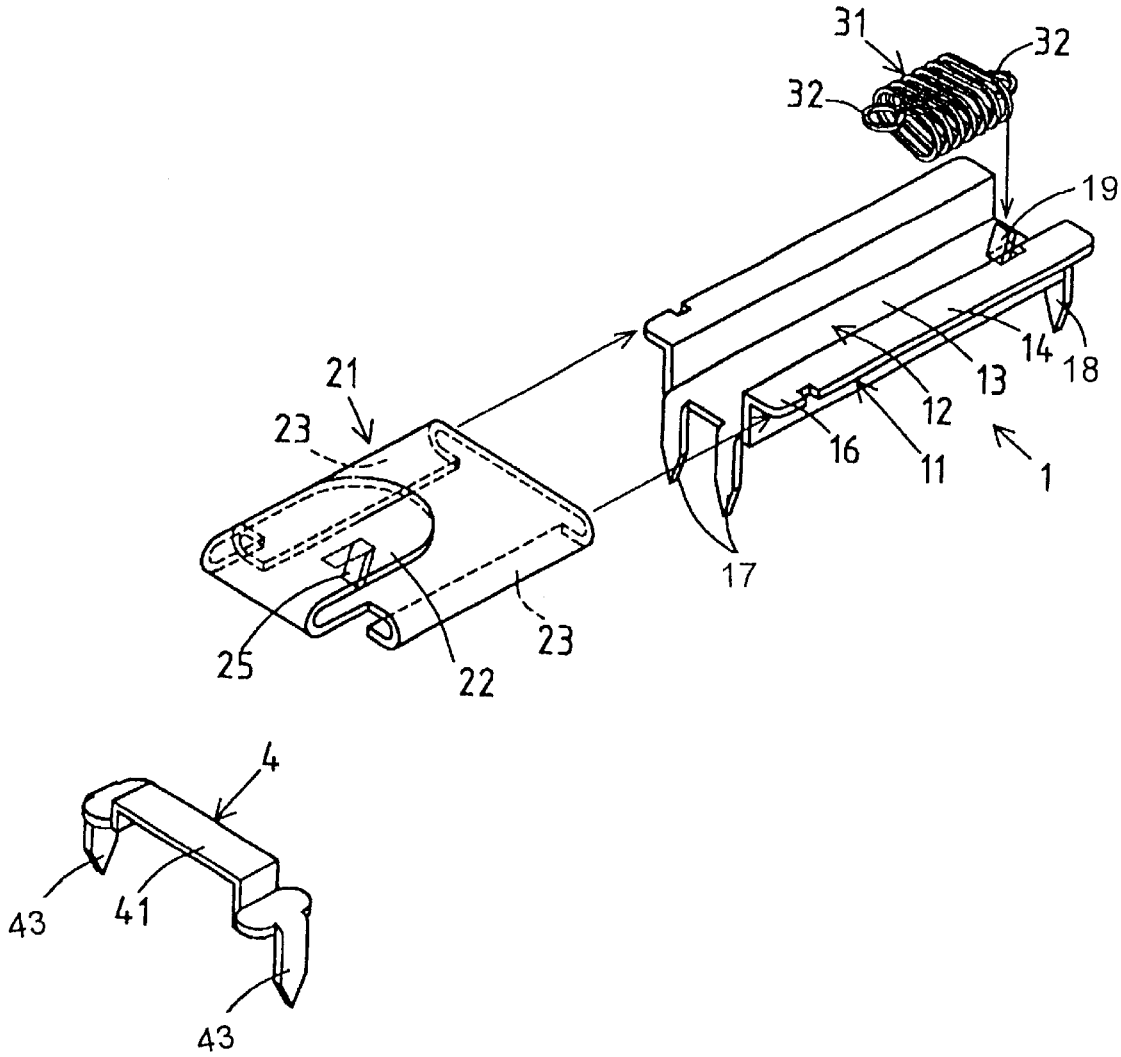
FIG. 5 is a perspective view of the hooking device according to Example 2 as it is assembled.
Figure 6:
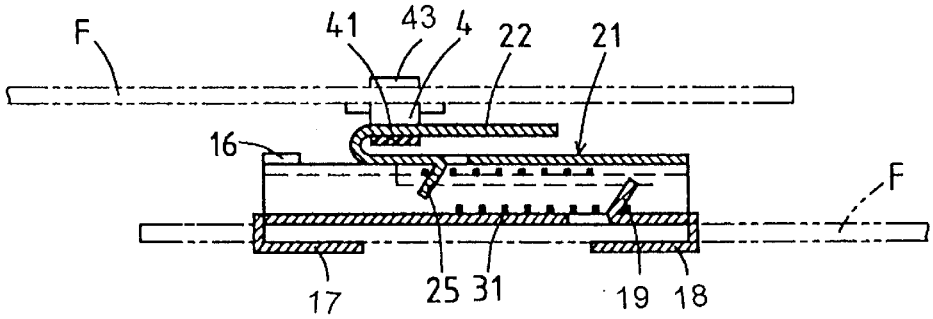
FIG. 6 is a longitudinal section view of the hooking device as it is attached to the opening of a garment.

As shown in FIG. 5, the male hook base (11) is made by stamping, pressing and bending a brass sheet of a thickness of 0.6 mm into a form measuring 11.5 mm in width by 31 mm in length by 3.6 mm in thickness and provided on its longitudinal center with a concave groove (12) having a uniform cross section and a width of 6.0 mm and a depth of 3.0 mm. On either side of the groove (12) there is a sliding rail (14) that functions as a guide along which the male hook main body (21) slides, and at either end of the groove bottom (13) there are two tongues, which bend in the direction of the back surface of the groove bottom (13) to form claws (17, 18). At one end of the groove bottom (13) there is a slit from which a bent hook protrusion (19) for hooking an end of the elastic body (31) protrudes into the groove (12). Near the other end of the male hook base (11), a slit is provided on each sliding rail (14) at positions equidistant from the end of the male hook base (11). These slits form slip-off-preventive pieces (16).

The male hook main body (21) is also made by bending a brass sheet of a thickness of 0.6 mm in the same way as the male hook base (11). So as to hold the sliding rails (14) of the male hook base (11) in a sliding manner, both sides are folded on one surface to form holding arms (23) while securing a width of 12.6 mm and a gap of 1.2 mm. A tongue formed at one end is folded on the side opposite the surface on which the holding arms (23) are folded to form a hooked end (22) that hooks onto the female hook (4). A slit is provided in the center portion of this female hook, and another bent hook protrusion (25) that hooks onto the other end of the elastic body (31) is formed by bending on the same surface as the holding arms (23).

Said elastic body (31) is a coil spring flattened to a width of 5.0 mm and a height of 2.7 mm. At each end of the spring, there is a loop (32) that hooks onto either of the hook protrusions (25) formed on the male hook base (11) and the male hook main body (21).

Said female hook (4) is formed by bending a brass sheet, and equipped with a catch (41) wide enough to hook onto the hooked end (22) of the hook main body (21) and with claws (43) of the same sort as those on the male hook base (11) at either end of said catch (41). These claws (43) penetrate the garment (F) and bend, thereby fastening the hook onto the garment (F).

The assembly of the hooking device of the present invention is as follows. As shown in FIGS. 5 and 6, the elastic body (31) is housed in the groove (12) with one end hooked onto the bent hook protrusion (19) of the male hook base (11). The other end of the elastic body (31) is expanded and hooked onto the bent hook protrusion (25) established in the center of the male hook main body (21). Then the male hook base (11) is inserted into the male hook main body (21) from the side opposite the side where the hooked end (22) is formed in such a way that the holding arms (23) hold the sliding rails (14). Then the slip-off-preventive pieces (16) formed on the sliding rails (14) are bent upwards so that the male hook (1) does not slip off from the sliding rails (14).

Figure 7:
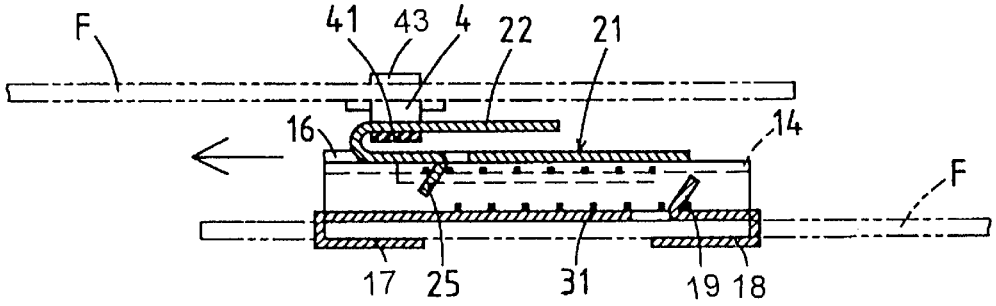
FIG. 7 is a longitudinal section view of the hooking device of FIG. 6 in which the male hook main body is sliding.

As shown in FIG. 7, when the female hook (4) attached to the opening of the waist of the garment (F) and the male hook main body (21) hooked onto said female hook (4) are pulled from each other in resistance to the elasticity of the elastic body (31), the elastic body (31) is pulled and expanded. At this time, the male hook main body (21) moves relative to the male hook base (11), thereby expanding the waist size of the garment (F). On the other hand, when the power to pull the male hook main body (21) decreases, the male hook main body (21) is drawn in the direction that reduces the waist size of the garment (F). Accordingly, the waist size of the garment (F) is automatically adjusted.

EXAMPLE 3

An adjustable hooking device according to Example 3 of the present invention will now be described with reference to the accompanying FIGS. 8–12.

The adjustable hooking device of the present example comprises an elongate male hook (1) attached to the inward-facing side of the openable inter-facing part of the garment (F) and a female hook (4) attached to the outward-facing side of the same openable inter-facing part.

Figure 8:
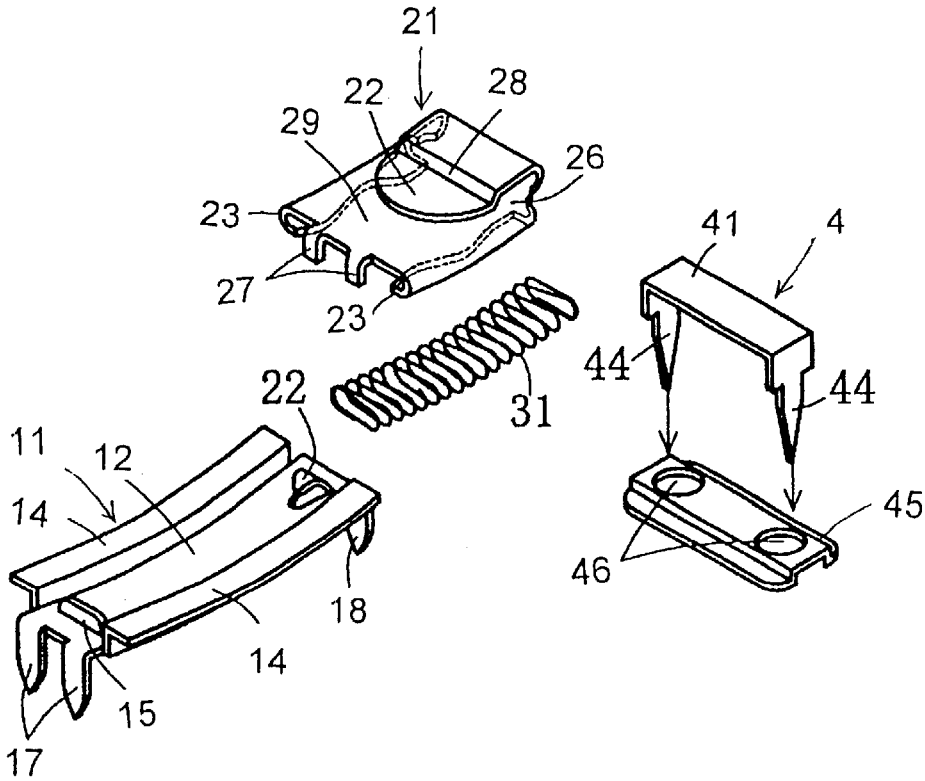
FIG. 8 is an exploded perspective view of the adjustable hooking device according to Example 3, of the present invention.
Figure 9:
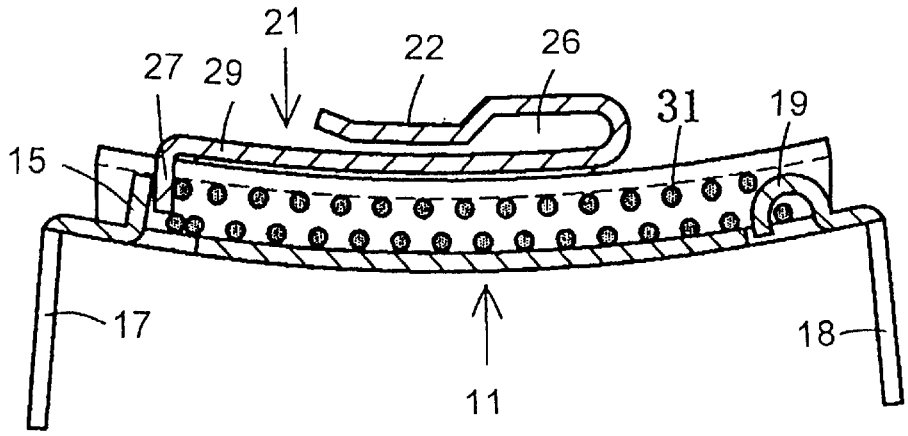
FIG. 9 is a longitudinal expanded sectional drawing of the movable hook.
Figure 10:
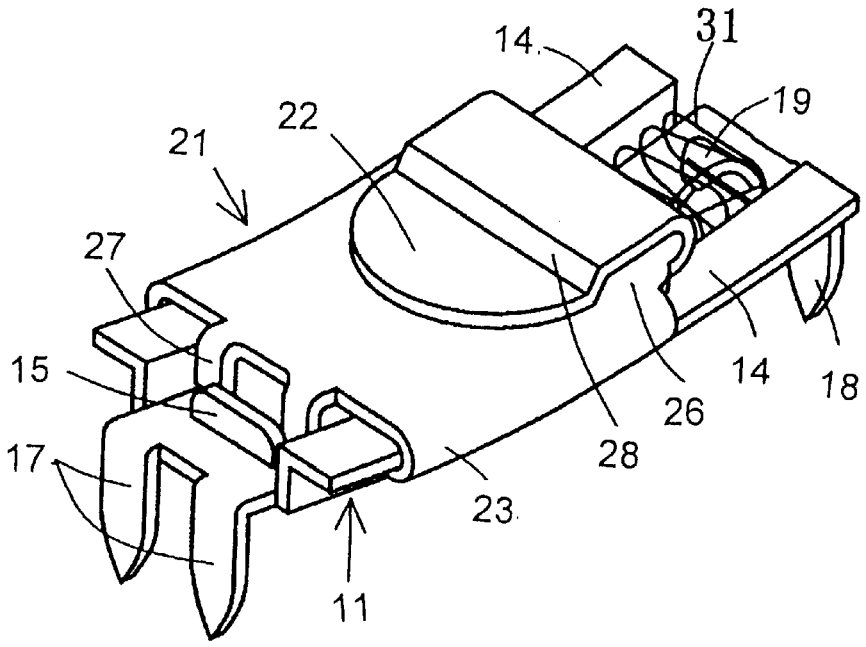
FIG. 10 is a general perspective view of the movable hook.
Figure 11:
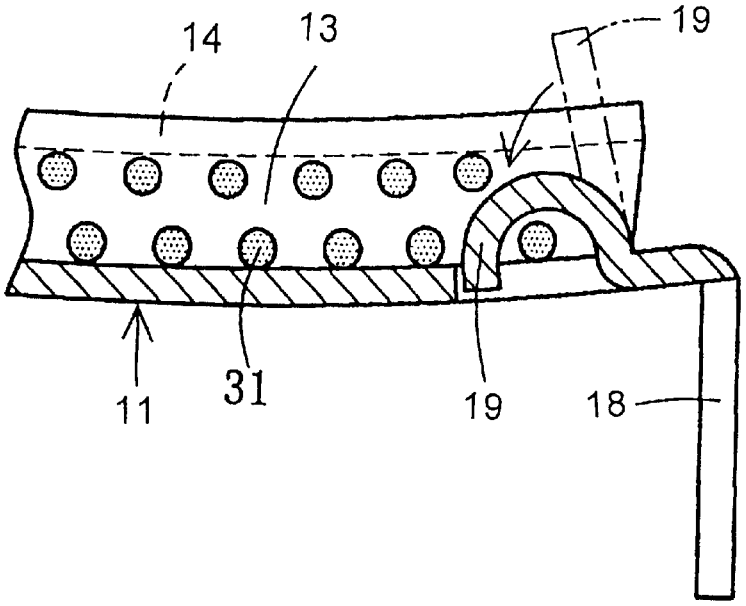
FIG. 11 is an explanatory drawing illustrating the way one end of the compression coil spring is joined to the hook base.

The male hook (1) comprises, as shown in FIGS. 8 to 10, a male hook base (11), a male hook main body (21) which slides using the male hook base (11) as a guide, and a compressed coil spring (31).

To make the male hook base (11), a stainless steel sheet of a thickness of 0.6 mm is stamped and pressed to create a curved shape of a radius of 65 mm. The male hook base (11) is attached longitudinally to the waist line with its convex surface facing the attachment surface. A concave spring-housing groove (12) having a longitudinal cross section of a width of 6.0 mm and a depth of 2 mm is formed and provided with a sliding rail (14) on either side of its opening, resulting in an external profile having a width of 11.5 mm by a groove length of 25 mm by a thickness of 2.5 mm by an overall length of 40 mm. Either end of the bottom of the groove (12) is extended to form a yoked claw (17, 18). A stopper (15) is established at one end of the inside of the bottom of the groove (12), and a stopping piece (19) bent towards the longitudinal center is erected at the other end thereof.

To make the male hook main body (21), a stainless steel sheet of a thickness of 0.6 mm is stamped and pressed to create a curved surface that fits the longitudinal curvature of the male hook base (11). On either side of a base plate (29) that covers the top of the groove (12), a holding arm (23) that holds the sliding rail (14) is integrally formed. At one end of the sliding orientation of the base plate (29), a hook-shaped piece is established in such a way that it can be folded back to form a hooking piece (22) that creates a hooking space (26) on the upper surface of the base plate (29). At the other end thereof, protruding-piece-forming pieces for forming protruding pieces (27) that correspond to the stopper (15) are established. The hook-shaped piece and the protruding-piece-forming pieces are bent to form the hooking piece (22) and the protruding pieces (27) respectively.

The hook-shaped piece is folded back in the direction of the curved concave surface. Between the tip of said hook-shaped piece and the fold of the base plate (29), an inclined step (28) is formed in such a way that it bulges from the surface of the base plate (29). The hooking piece (22) is formed by folding the base plate (29) back so that a hooking space (26) is created between its root and the surface of the base plate (29). The hooking space (26) continues to the gap at the tip of the hooking piece (22) while being narrowed along the way by the inclined step (28) between the fold and the tip.

The protruding pieces (27) are formed by bending the protruding-piece-forming pieces towards the back of the base plate (29) in such a way that they correspond to the stopper (15). One end of the compressed coil spring (31), which is explained in the next paragraph, is arranged to make contact with these protruding pieces (27).

The compressed coil spring (31) fits into the depth and width of the groove (12). A circular spiral compressed coil material with a springy property is deformed to create a flat shape such as a rectangular spiral or elliptical spiral. One end of the coil spring (31) makes contact with the protruding pieces (27) of the male hook main body (21), and the other end makes contact with the stopping piece (19) erected on the hook base (11). By bending the stopping piece (19) downward, the end of the coil spring (31) is fastened. (See FIG. 11)

The interconnection between the components of the male hook (1) should be apparent from the description of each part as explained above. To make it even clearer, the order of assembly will now be described with reference to FIG. 8. The male hook main body (21) is inserted from the end where the stopping piece (19) of the hook base (11) is formed. At this time, one end of the compression coil spring (31) is in contact with the protruding pieces (27), and the holding arms (23) are guided by the sliding rails (14) so that the male hook main body (21) covers the groove (12). Then the other end of the compression coil spring (31) is brought into contact with the inside of the stopping piece (19). At this time the compression coil spring (31) is slightly compressed and deformed. Then this other end is caught by the bend of the stopping piece (19) (see FIG. 11) and fastened.

The female hook (4), which forms a pair with the male hook (1), comprises a catch (41), formed by bending a stainless steel sheet into a gate shape, and a back plate (45). The catch (41) has penetrating and bending claws (44) for attaching to the garment (F). The back plate (45) is provided with a penetrating-claw hole (46) on either end.

Figure 12:
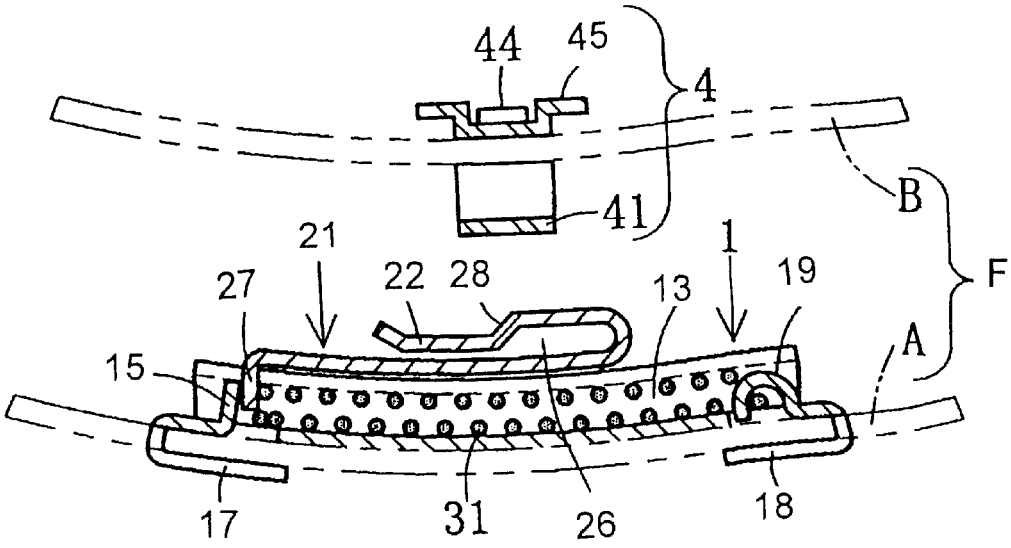
FIG. 12 is a schematic sectional drawing of the adjustable hooking device as it is attached to the openable inter-facing part of the garment (F).

The adjustable hooking device made of the male hook (1) and the female hook (4) as described above is used as follows. As shown in FIG. 12, the male hook (1) is sewn onto the inward-facing side of the outside fabric (A) of the openable inter-facing part of the garment (F), whereas the female hook (4) is sewn to the outward-facing side of the inside fabric (B) of the openable inter-facing part of the garment (F). The hooking piece (22) is used in such a way that it is hooked onto the female hook (4). The male hook (1) and the female hook (4) are attached to the respective sides of the openable inter-facing part of the garment (F). When a force is applied in the direction of opening the openable inter-facing part, the compression coil spring (31) mounted on the male hook (1) is compressed and deformed, and when the force is released, the compression coil spring (31) returns to its original form. The waist size is thus automatically adjusted to the size that best suits the wearer.

The above examples are not the only possible embodiments of the present invention. The dimensions and shape of the hooking device of the present invention can be altered according to the purpose and use thereof.

For example, the male hook main body (11) and elastic body (31) may be extended in the longitudinal direction to increase the slidable distance of the male hook main body (21). The female hook (4) can be provided with the same expandable characteristics as the male hook (1) in order to increase the range of automatic adjustment.

The elastic body (31) housed in the housing space formed by the male hook base (11) and male hook main body (21) is not restricted to a choice between a leaf spring made by bending a metal band material into a bellows shape or a coil spring. The elastic body (31) can be of any material as long as it possesses a degree of elasticity that adjusts the size of the garment (F) to the waist size of the wearer and sufficient durability to last over the usage life of the garment (F) in question. For example, an elastic material made of synthetic rubber or a sheet metal having the same sectional shape as that of a disc spring can be used. It is further possible to make the male hook base (11) and male hook main body (21) of a sheet metal of either brass or stainless as well as of other metallic materials or synthetic resin materials.

As a means of attaching the hooking device to the opening of the garment (F), other known attachment means can be used as an alternative to the sewing means or claws. In the case of a synthetic resin hooking device, it can be deposited into an opening in the garment (F). It is also possible to sew a thin tongue protruding from the male hook base (11), for example, together with the opening of the garment (F).

What is claimed is:

1. A hooking device comprising a male hook attached to one side of the opening of a garment and a female hook attached to the other side of the opening in such a way that it can be hooked to and unhooked from said male hook;

said male hook comprising: a male hook base on which a groove housing a later-described elastic body is longitudinally formed; a male hook main body which secures a space for housing the later-described elastic body between itself and the male hook base and is provided with a means for hooking to said female hook, wherein said male hook base also functions as a guide member; and the elastic body housed in said male hook base in such a way that it elastically controls the sliding movement of the male hook main body with respect to the male hook base by means of compression or tension.

2. A hooking device according to claim 1 wherein sliding rails are provided on both ends of the male hook base, both ends of the male hook main body are folded back to one surface so as to form holding arms that hold the sliding rails in such a way that the rails can slide freely within them, and the male hook base and the male hook main body are attached to each other in such a way that they can slide by each other with the holding arms holding the sliding rails, further provided with a stopper means for preventing these parts from becoming separated from each other.

3. A hooking device according to claim 1, wherein the male hook base and the male hook main body are equipped with, respectively, a stopper protrusion and a pusher protrusion, both of which protrude into the housing space, wherein both ends of the elastic body housed in the groove are compressed by said stopper protrusion and pusher protrusion in order to elastically control the sliding movement of the male hook main body with respect to the male hook base.

4. A hooking device according to claim 1, wherein the elastic body is formed by bending a metal band material in the form of bellows having a width that allows it to be housed in the groove.

5. A hooking device according to claim 1, wherein the elastic body is a coil spring having a width that allows it to be housed in the groove.

6. A hooking device according to claim 1, wherein the male hook and the female hook are curved along the waist line.

7. A hooking device according to claim 6, wherein one end of the elastic body makes contact with protruding pieces formed on the back surface of the end that is opposite the end of the mail hook main body where the hooking piece is formed, and the other end of which is caught and fastened by the bend of a stopping piece erected from the male hook base, and the hooking space of the hooking piece continues to the gap between the tip of the hooking piece and the male hook main body while being narrowed along the way by an inclined step provided between the fold and the tip of the hooking piece.

* * * * *